United States Patent [19]

von Hagen

[11] 4,389,951

[45] Jun. 28, 1983

[54] MATERIAL DISPENSING MEANS FOR SEWING MACHINES

[75] Inventor: Wolf R. von Hagen, Hemmingen, Fed. Rep. of Germany

[73] Assignee: Union Special G.m.b.H., Stuttgart, Fed. Rep. of Germany

[21] Appl. No.: 238,773

[22] Filed: Feb. 27, 1981

[30] Foreign Application Priority Data

Feb. 29, 1980 [DE] Fed. Rep. of Germany ..... 3007652

[51] Int. Cl.[3] ..... D05B 23/00

[52] U.S. Cl. ..... 112/121.27; 112/307; 226/42; 226/195; 242/55; 242/75

[58] Field of Search ..... 112/121.27, 121.26, 112/121.11, 2, 152, 307, 305, 303; 226/42, 195; 242/55, 75

[56] References Cited

U.S. PATENT DOCUMENTS

| | | | |
|---|---|---|---|
| 2,754,114 | 7/1956 | Weinkle et al. | 112/121.27 X |
| 2,814,676 | 11/1957 | House | 242/55 X |
| 3,561,691 | 2/1971 | Nichols et al. | 242/55 |
| 3,721,376 | 3/1973 | Christian et al. | 226/42 |
| 3,722,822 | 3/1973 | Wellace | 242/55 X |
| 3,856,224 | 12/1974 | Van der Aa et al. | 242/55 |

*Primary Examiner*—H. Hampton Hunter

*Attorney, Agent, or Firm*—John W. Harbst; John A. Schaerli

[57] ABSTRACT

The present invention relates to a material dispensing apparatus having a unique closed loop servo system for advancing material to a receiving machine in accordance with the use demands thereof.

11 Claims, 3 Drawing Figures

MATERIAL DISPENSING MEANS FOR SEWING MACHINES

FIELD OF THE INVENTION

The present invention relates to sewing machines, and more particularly, to a mechanism for dispensing tape or strip-like materials to a sewing machine as required thereby.

BACKGROUND OF THE INVENTION

Sewing machines having various mechanisms for delivering material to the sewing area under light tension are known in the art. An example of such mechanisms is shown in U.S. Pat. No. 2,754,114 issued July 10, 1956 to A. Weinkle et al. In this patent, the delivery of tape to the machine is dependent on the degree of tension on the tape in the area between the pull-off mechanism and the sewing machine. The drive motor in this patented device is continually switched on and off by means of a control element that scans the tape. In a second disclosed embodiment, an operably engagable clutch mechanism is arranged between the drive motor and the pull-off mechanism. In either embodiment, the mechanism is directly subjected to severe changes in sewing speeds and, as a result, the tensioning of the tape being fed to the machine is effected thereby. The named patent describes a third variant wherein a mechanical connection between the sewing machine and the pull-off mechanism is established. In this form, the pull-off mechanism operates according to the speed of the machine. Even with the transmission apparatus shown in this third variant, slippage of the workpiece and other negative influences affect the efficient operation of the apparatus.

U.S. Pat. No. 3,856,224 issued Dec. 24, 1974 to H. Van der Aa reveals a more recent attempt at a solution to industry's continued demand for an effective tape dispensing apparatus. This patented apparatus shows a motorized dispensing mechanism which is controlled by the amount of tape that is consumed in the sewing operation. Angular movement of a pivotal arm, adapted to ride in a tape loop, controls the feed rate of this apparatus. Yet, an apparatus, as described, which responds to rather than anticipates the use requirements of the receiving machine is not sufficient.

SUMMARY OF THE INVENTION

As disclosed hereinafter, the present invention has essentially solved the drawbacks of the heretofore known devices and answers the needs of today's industry. The present invention includes a tape dispensing apparatus having a pair of cooperating rollers that are positively driven by a unique closed loop servo system. The closed loop servo system includes a control apparatus and a driver that is coupled to the sewing machine and which is sensitive to changes in the machine's speeds. The control apparatus is effective to operate the tape dispenser at a speed or rate which is selectively proportional to the machine speed. That is, the instant tape dispenser is adapted to operate at varied rates of advancement relative to the machine. In this manner, factors which influence sewing speed, such as, stitches, stitch length, and workpiece slippage can be accounted for prior to operation of the machine. The control apparatus also includes a comparator which operatively measures the advance rate of the tape dispensing means against the machine's use requirements and effects tape advancement as a resultant of that measurement. Further included within the system are means which assure a controlled response to the machine's demand for an increase in the supply of tape.

With the above in mind, it is a primary object of this invention to provide an apparatus which effectively and efficiently provides tape to a machine as required thereby.

Another object of the present invention is the provision of an apparatus which will furnish tape to a receiving machine at a rate consistent with the demands of said machine.

It is another object of this invention to provide an apparatus with simple controls so that it is sensitive to changes in the machine's operation although indirectly independent thereof.

These and other objects will become apparent from the following description and appended claims when read in conjunction with the attached drawings, in which;

DETAILED DESCRIPTION OF THE PRESENT INVENTION

Figure 1:
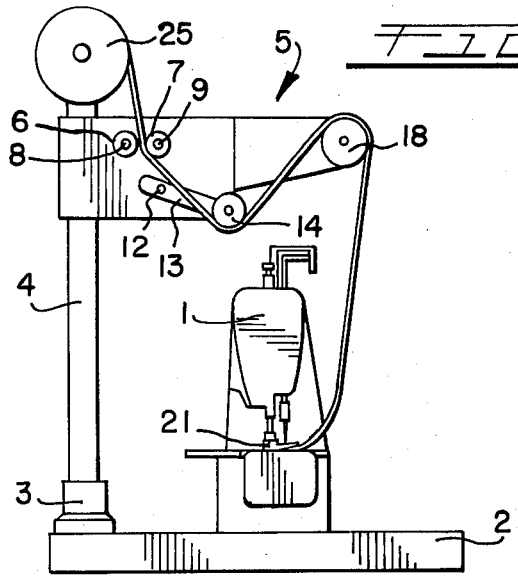
FIG. 1 is a schematic side elevational view of the present invention.
Figure 2:
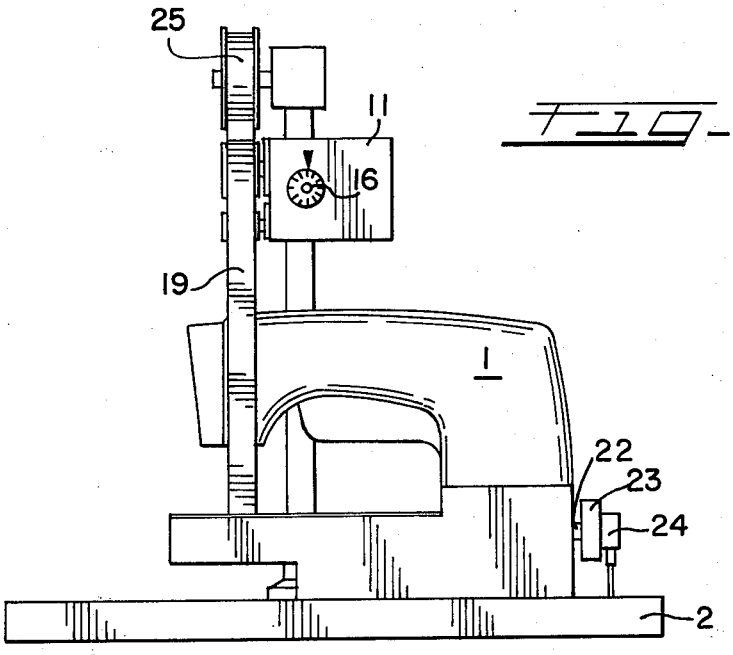
FIG. 2 is a schematic elevational view of the present invention.

Referring now to the drawings, wherein like reference numerals indicate like parts throughout the several views, there is shown a sewing machine 1 mounted on a table 2. Suffice it to say that the machine includes a presser foot 21, reciprocatory needle means defining a sewing station and a feed mechanism for incrementally moving the workpiece through the sewing station. The feed mechanism may be of any well known type and includes means for selectively altering the stitch length produced by the machine. Associated with the machine 1 is the material dispensing means 5 which is arranged proximate the machine 1. The material dispensing means is secured in the vicinity of the machine by means of a vertical support member 4 secured to the table 2 by means of a flange 3 or other suitable means.

The material dispensing means of the present invention includes means for withdrawing material from a supply roll 25. The drawing illustrates a roll of material which may be in the form of a tape or strip-like material 19. It will be appreciated, however, that various aspects of the present invention are adaptable to other applications. The tape dispensing means includes a pair of visible, rotating, cooperatively arranged members 6, 7 adapted to pull the tape from the roll and move it toward the receiving machine 1. A system of cooperating inner parts and components, enclosed, for the most part, in housing 11, are employed for driving the rollers 6, 7. The present invention includes a pair of shafts 8, 9 on which rollers 6, 7 are respectively mounted and a motor or driver 10. The motor 10 may be operatively connected to either of the shafts 8, 9 such that the tape is fed through the positive rotation of the rollers 6, 7.

Figure 3:
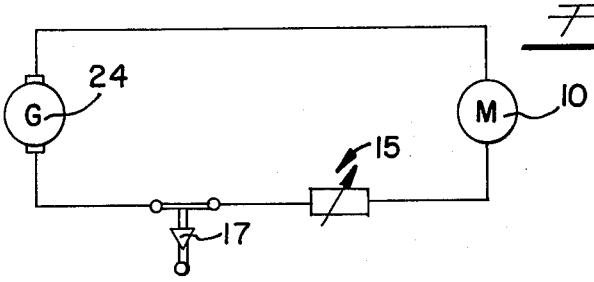
FIG. 3 is a schematic diagram of the closed loop control system of the present invention.

Disposed between the feed rollers 6, 7 and the receiving machine 1, are movable means which, as described hereinafter, compare or measure the advance rate of the tape dispensing means with the use requirements of the machine 1. In the preferred embodiment, such sensor or measuring means include a frame or arm 13 that is secured at one end to the distal end of a shaft 12. The shaft 12 is arranged in the housing 11 to allow vertical adjustment of the arm 13. At its other end, the arm 13 is provided with a roller 14 beneath which the tape passes in its path to the receiving machine 1. A spring or adjustable counterweight (not shown) may be associated with the arm 13 to effect operation of a switch 17 (FIG. 3) forming part of the tape dispensing control unit. In the illustrated embodiment, the tape passes from beneath the roll 14 and thence over a stationary guide roller 18. It will be understood that the rollers included in this system and their mounting means are positionally arranged to constitute a slack take-up, the roller 14 serving to tension the moving tape.

In addition to the switch 17, the tape dispensing control unit further includes a first control unit 24 and a second control unit 15. The serially connected first and second control units are arranged in a closed loop servo system (FIG. 3) including the tape dispensing actuator or motor 10.

The first control unit 24 consists essentially of a pulse producing mechanism that is adapted to sense the speed of the machine and regulate the speed of the motor 10 as a function thereof. As illustrated, the control unit 24 may take the form of a tachometer or generator that is arranged on the free end of the machine main shaft 22 adjacent the handwheel 23. When mechanically driven, the generator produces an output voltage proportional to the machine speed.

The second control unit 15 consists essentially of an operator controlled means, for example a potentiometer and the switch 17. This control unit is selectively adjustable by means of an easily accessible knob 16 arranged on the front of housing 11. The control unit 15 is adapted to selectively control the speed of the motor 10 in proportion to the speed or feed rate of the machine. That is, the knob 16 has graduations thereon which are reflective of various stitch lengths. In this manner, the control unit may be tuned to the stitch length preset on the machine. It should be noted, however, that the control unit 15 is controlled as desired by the operator. Hence, by varying the speed of the motor 10, the speed or feed rate of the tape dispensing means may be selectively varied relative to that of the main shaft 22 and the machine 1.

In operation, tape may be supplied to the receiving machine according to the speed and stitch length of the machine. That is, the second control unit may be selectively tuned such that it controls the feed advancement of the tape dispensing means to be in agreement with the preset stitch length and, thus, demands of the machine. Preferably, however, the feed rate of the tape dispensing means slightly exceeds the demands of the machine as measured by the generator. It will thus be observed that when the speed at which the tape is fed exceeds that at which the tape is drawn into the receiving machine, the slack in the tape will increase, allowing the arm 13 to descend whereby opening the switch 17 and preventing the further delivery of tape to the machine by disconnecting the motor 10. When the continued operation of the machine consumes or uses the excess tape, the slack will decrease thus raising the arm 13. When the arm 13 raises it again closes the switch 17. The switch 17 is of the type, however, that the motor is reactivated at a variable rate. That is, the motor is not immediately turned to its full speed but rather a gradual increase in the speed of the motor results when the switch is closed thus avoiding a continual switching on and off of the motor.

By this construction, there is provided a tape dispensing apparatus which is adapted to supply material to a receiving machine according to the use demands thereof but is further refined to accommodate changes in the operations of the machine. With the present invention, a continuous and evenly distributed tension is applied to the material being fed to the receiving station, thus assuring a smoother sewing operation.

Thus, it is apparent that there has been provided, in accordance with the invention, a Material Dispensing Means for Sewing Machines, that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What I claim is:

1. In combination with a machine capable of having a strip-like material fed therethrough, a mechanism suited for use in supplying strip like material from a source thereof to said machine, said mechanism comprising:

means adapted to feed the strip-like material to said machine at a rate which is function of the machine speed;

means for automatically controlling the feed means in response to a control signal having a selective premeasurable value proportional to the speed of the machine; and means responsive to variations in the speed of said machine and the feed rate of the feed means for controlling the amount of material being fed to the machine.

2. A device for automatically delivering tape from a supply roll to a sewing machine in accordance with the operational demands of the latter, comprising, in combination:

operative means responsive to the operative speed of the machine and arranged proximate thereto for withdrawing tape from the supply roll and delivering it to said machine;

means adapted to selectively control the withdrawal rate of the operative means as a function of machine speed; and comparator means for varying the withdrawal rate of the operative means relative to the demands of the sewing machine as a function of the amount of tape between the withdrawing means and said sewing machine.

3. A mechanism for feeding strip-like material from a source thereof to a receiving machine comprising:

means drivingly connected with the receiving machine for feeding the strip-like material to the receiving machine;

means for operating said feeding means at a premeasured comparable ratio with that of the receiving machine; and a device for taking up and paying out slack in the strip-like material fed to the machine, said device being capable of automatically varying the operation of said feeding means relative to the speed of the machine in accordance with slack variations.

4. A mechanism according to claim 3 wherein the paying out of slack in the strip-like material is effected in a predetermined manner.

5. An apparatus suited for use in supplying tape from a source thereof to a machine, comprising:

tape dispensing means coupled to a closed loop control means, said closed loop control means including motor means for operating said tape dispensing means in response to machine speed, means coupled to said motor means for producing a command signal controlling the operation of the tape dispensing means, and comparator means which operatively measures the advance rate of the tape dispensing means against machine use requirements and effects the tape advancement as a resultant of that measurement.

6. In a mechanism for feeding material from a roll to a receiving machine comprising:

operative means for sensing the speed of said machine;

operative means capable of producing a signal having a value proportional to the speed of the machine;

means to be operated jointly by both of said operative means for withdrawing material from said roll and feeding same to said machine; and means for automatically varying the operation of said withdrawing means with respect to said machine speed according to the amount of slack in the material being fed.

7. An apparatus suited for use in supplying tape from a source thereof to a machine comprising:

first means for withdrawing and feeding tape from said source to said machine;

second means associated with the machine for sensing the speed thereof and for effecting the operation of said first means;

third means coupled to said first and second means for operating said first means at a predetermined ratio with respect to said machine speed and automatically varying the speed of said first means as a function of tape usage.

8. An apparatus according to claim 7 wherein said third means is coupled in series with said first and second means.

9. A mechanism suited for use in supplying a striplike material from a source thereof to an apparatus requiring said material to effectively operate, said mechanism comprising:

means responsive to the speed of and adapted to deliver the material to said apparatus;

means adapted to operate the means responsive at a selective speed that is proportional to the speed of the apparatus; and means responsive to variations in the apparatus use requirements and the selected speed of said operating means for automatically effecting the amount of material delivered to said apparatus.

10. A mechanism suited for use in supplying tape from a source thereof to a machine requiring said material to effectively operate, said mechanism comprising:

means for delivering tape to the machine as a function of machine speeds;

means adapted to operate said delivery means at a selective speed that is proportional to the speed of the machine; and a device for measuring machine use requirements and the selected speed of said delivery means and effective to prevent the further delivery of tape to the machine until excessive slack variations in the tape have been exhausted.

11. A mechansim capable of feeding tape from a tape source to a sewing machine in response to the premeasurable use requirements of said machine, comprising:

operative means coupled to said machine for withdrawing tape from said source and feeding same to said machine;

means operatively responsive to said machine for governing the operation of said operative means at a selective proportional rate relative to machine; and automatic means adapted to vary the operation of said operative means subject to excessive variations in the use requirements of the machine and the governed speed of said operative means.

* * * * *